United States Patent [19]

Scharf

[11] 4,407,040

[45] Oct. 4, 1983

[54] PAD DRIVE FOR ROTARY SCRUBBER

[75] Inventor: Stephen Scharf, Melville, N.Y.

[73] Assignee: Universal Brush Company Ltd., Babylon, N.Y.

[21] Appl. No.: 330,180

[22] Filed: Dec. 14, 1981

[51] Int. Cl.[3] ..... B24B 29/00

[52] U.S. Cl. ..... 15/230.17; 15/98; 51/358

[58] Field of Search ..... 15/230.17, 98, 97 R, 15/230, 230.14, 230.16, 230.18, 230.19, 257; 51/358, 177, 388

[56] References Cited

U.S. PATENT DOCUMENTS

| | | | |
|---|---|---|---|
| 3,115,660 | 12/1963 | Hunt | 15/230.17 |
| 3,425,087 | 2/1969 | Fitzhugh | 15/230.17 X |
| 3,527,001 | 9/1970 | Kleemeier et al. | 15/230.17 X |
| 3,823,516 | 7/1974 | Christian | 51/358 |

FOREIGN PATENT DOCUMENTS

| | | | |
|---|---|---|---|
| 163824 | 11/1933 | Switzerland | 15/230.17 |

*Primary Examiner*—Edward L. Roberts

*Attorney, Agent, or Firm*—Bauer & Amer

[57] ABSTRACT

A pad drive assembly that detachably grips and rotatably drives a selected maintenance pad by a floor maintenance machine, comprises a rigid, substantially circular back support that has two faces, one of which is substantially planar. A substantially rigid pad drive or grip plate of planar, circular configuration is defined by two faces. One of the last mentioned faces is bonded to the planar face of the back support for rotation therewith. The other face of the pad drive is formed with a plurality of substantially rigid, upstanding pins that extend therefrom and that are adapted detachably to grip the selected maintenance pad and rotatively drive the same.

21 Claims, 15 Drawing Figures

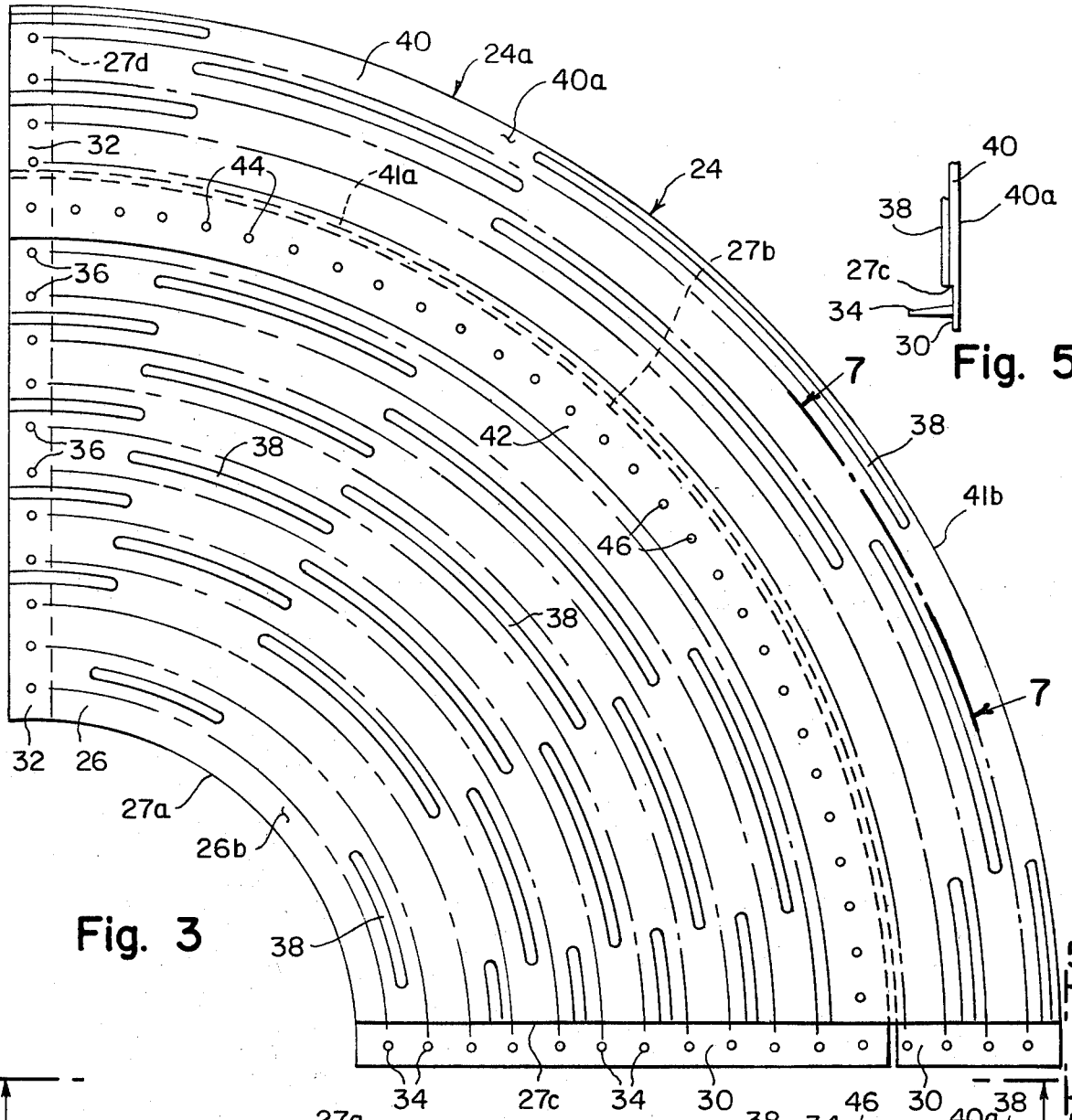
Fig. 3
Fig. 5
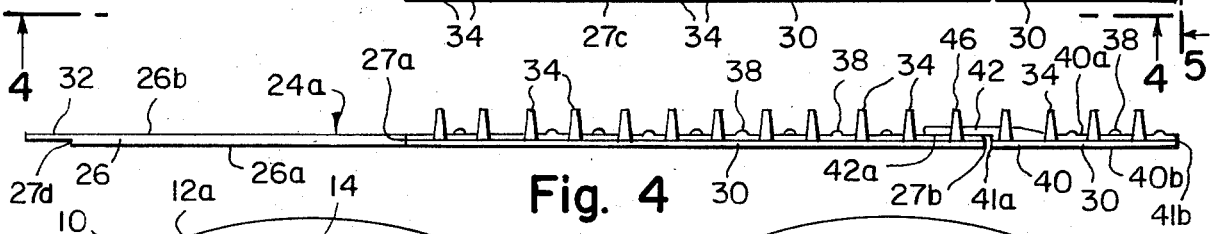
Fig. 4
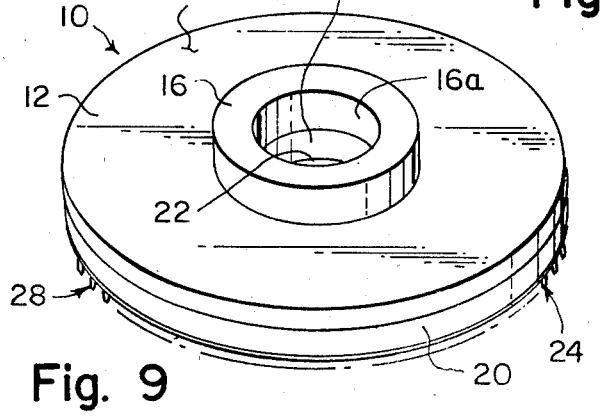
Fig. 9
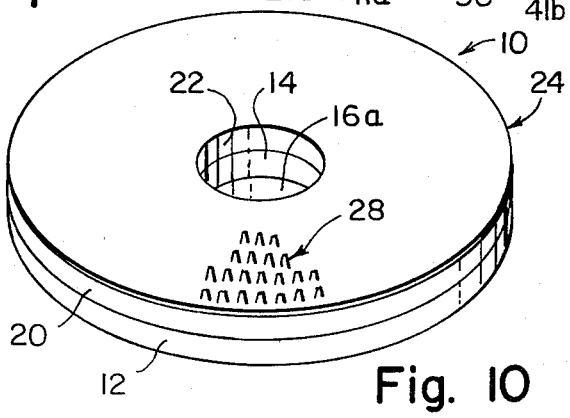
Fig. 10

PAD DRIVE FOR ROTARY SCRUBBER

This invention relates to a drive assembly for a rotary scrubber, and more particularly it relates to a planar, circular drive assembly for floor maintenance machines that are employed commercially and in the household.

Floor maintenance machines utilize various pads for polishing, stripping, scrubbing, spray buffing and the like. The machines include a pad drive assembly by which the selected maintenance pad, for example, a pad used for polishing, is attached to the machine and driven thereby. Heretofore, these pad drive assemblies have had various constructions.

Conventionally, such constructions have included a planar back support one face of which is attached to a clutch plate and a riser. The other planar face of the back support supports a brush-like array of bristles. These bristles are intended to engage and disengage from the interstices of the selected pad when the pad is pressed onto the planar face presented by the free ends of the bristles. This bristle-like array used in the prior art formed an interface, as it were, between the machine and the selected pad. This type of interface permitted attachment and detachment of the selected pad quickly and easily with the expectation being that when the bristles comprising the pad drive assembly engage the selected pad, the bristles of the pad drive assembly would hold the selected pad firmly.

However, owing to the nature of forces exhibited by the rotary drive pad, and work surface reacting thereon, the bristles tend to bend and deform, leading to uneven polishing action, or, worse yet, having the bristles extend through the pad and, for example, scratch the floor being polished. Then, too, with high speed machines, the pad tends to shift position with respect to a given, incipient position on the bristles, leading to loss of polishing area, if not total loss (fly-off) of the pad from its support with damage to surrounding people and articles.

In order to reduce the tendency for the selected maintenance pad to shift position with respect to the bristles, in some prior assemblies some of the bristles have been canted or tilted out of their normal linear position so as to be angularly disposed with respect to the backing plate. Indeed, in some prior constructions the deformable bristles have been provided with bent ends to provide for a more complete engagement with the selected pad. However, these structures are relatively expensive and do not provide for a complete positive interfacing or connection between the maintenance pad and machine, because with these more exotic bristle formations the selected pad can still shift relative to the bristles.

The present invention overcomes the significant problems outlined above. In one embodiment of the present invention, a novel pad drive assembly comprises a circularly configured planar back support, one face of which supports a riser block and clutch plate that is detachably attached to the shaft of the machine. A planar shock absorber, complementary in size to the exposed planar face presented by the back support, and acting to absorb start-up and shock loads, is attached thereto to be driven rotatively thereby. A pad drive or grip plate, having one face of complementary sized planar construction, is attached to the planar face presented by the shock absorber.

The other and exposed face of the drive pad is formed with a plurality of relatively large diameter, upstanding substantially rigid linear pins. The distal ends of selected ones of these substantially linear pins are upset, which is to say that their exposed free ends are deflected out of the normal longitudinal line of the pin so as to cause the aforesaid end of the pin to assume an enlargement. This enlargement functions as a gripping engaging or locking end to fit into the interstices of the selected maintenance pad that is pressed thereon. The pins, and particularly the upset ends thereof, lock within the fibers of the selected pad that is pressed onto the pins and this assures a positive locking between the selected meintenance pad and the inventive drive assembly. The positive locking afforded by the inventive structure acts to resist the tendency of the selected maintenance pad to shift position relative to the pins, and extends the life of the selected maintenance pad.

Further, in addition to arranging the pins so as generally to be perpendicular to the plane of the drive assembly or drive pad, selected pins can be at an angle so as to be canted or tilted with respect to the aforementioned perpendicular orientation, to provide for multi-angled engagement with the fibers of the selected maintenance pad. And, it will be apparent that those pins that are not upset but that are left with their ends smooth will function to engage the fibers of selected pads that, by their nature or density, might be difficult to penetrate. Hence, these smooth ended pins will act to supplement the function of those upset pins that may not be able initially to penetrate deeply within the body of certain maintenance pads.

In addition to forming the inventive grip plate or drive face as a monolithic annular or circular whole, the inventive pad drive or grip plate can be formed as a plurality of sectors or segments that interengage. This provides flexibility in design size and reduces the tooling costs required to manufacture the inventive device. In accordance with this sectored construction, the pad drive or grip plate is divided into discrete sectors with each sector molded or cast as a duplicate of every other sector. Each sector is defined by two lateral edges. Each lateral edge is formed with interfitting mating ledges or interfitting seats as planar ledge means extending therefrom. A plurality of pins of constant cross-section upstand from one of the mating ledges.

Given ones of these pins are adapted to interfit with given ones of an array complementary sized apertures in an overlying or adjacent ledge. The interfitting seats or ledges are then bonded to each other along their common interface, and then, the inboard planar face of each sector is bonded to the facing planar surface presented by the shock absorber disc thereby forming the assembled structure. Moreover, by carrying this sectored or segmented construction further, the diameter of the grip plate can be enlarged or reduced by fabricating complementary sized outer peripheral rim segments of relatively larger radii. Such larger arc segments would then mate with the planar circumferential arcuate periphery of a given inner sector thus enlarging the annular face presented by the overall structure. This makes the inventive structure universally adaptable to maintenance machines of different sizes or diameters by simply adding additional outer rim sectors.

Since given selected maintenance pads that perform the various maintenance functions are not of a standardized or uniform thickness, the outboard face of the inventive grip plate or drive pad can be formed with a plurality of arcuate rib segments disposed in the annular spaces that concentrically defined between the linear pins. These rib segments act to raise the exposed or outboard annular planar face of relatively thinner maintenance pads beyond the free or exposed ends of the linear pins so that these pins will not interfere with the maintenance function.

In another embodiment of the present invention, the invention comprises a substantially rigid planar annular grip plate or drive pad that acts as an interface between a conventional bristle or brush assembly on the one side, and a selected maintenance pad on the other. To accomplish this, the inventive grip plate or pad drive is formed with a plurality of upstanding substantially rigid linear pins on each side. Selected ones of the pins on either side can have their free ends upset. They may be at an angle so as to be canted or tilted with respect to a vertical line drawn from the plane of the plate.

With this double sided pin construction, one side of the inventive disc can be pressed onto the planar face presented by the conventional brush assembly to interfit therewith and be held thereby by the intermeshing of given linear pins with facing bristles. The other side of the inventive grip plate or pad drive will be thus oriented outboard or outwardly directly from the planar face of the bristles and substantially co-planar therewith. The selected maintenance pad can then be pressed onto the aforementioned outwardly facing linear pins of the inventive pad drive to be held thereon by the lancing and holding action of these pins. The selected maintenance pad is then easily removed from the inventive interface by merely lifting the pad drive off the pad such that the weight of the pad causes it to fall off of the engaging pins.

It is, therefore, an object of the present invention to provide a pad drive assembly to be used on maintenance machines such that the pad drive assembly is adapted to engage with and disengage from a plurality of selected maintenance pads.

It is a further object of the present invention to provide a pad drive assembly for use with maintenance machines that includes an outwardly projecting grip plate with which to hold the selected maintenance pad and which is comprised of a plurality of linear pins or fingers, some of which have their free ends upset.

It is another object of the present invention to provide a drive pad assembly for maintenance machines that is easily attached to the drive shaft of such machines and that includes shock absorbing means that acts to dampen vibrations, start-up shock and the like.

It is a further object of the present invention to provide a drive assembly for maintenance machines wherein the assembly includes an outwardly facing grip plate comprised of interfitting planar sectors such that the planar arcuate area of the grip plate can be enlarged or reduced in size by adding or deleting appropriate peripheral rim segments.

It is another object of the present invention to provide an annular planar grip plate or drive pad that acts as an interface between a conventional bristled or brush-like drive assembly and the selected maintenance pad, and which includes means on each face of the grip plate detachably to interfit within the respective fibers of the aforesaid brush-like member and selected maintenance pad.

It is a still further object of the present invention to provide a pad drive assembly for maintenance machines that is adapted detachably to grab and hold all grades or densities of floor pads.

It is a further object of the present invention to provide a pad drive assembly for maintenance machines that is adaptable to a variety of such machines, is relatively lightweight and thus exhibits relatively low inertial mass, and that is low in cost.

Other objects and features of the present invention will become apparent from the following detailed description considered in connection with the accompanying drawings. It is to be understood, however, that the drawings are designed for purposes of illustration only, and not as a definition of the limits of the invention for which reference should be made to the appending claims.

In the drawings, wherein the same reference numeral denotes the same element throughout the several views.

Figure 1:
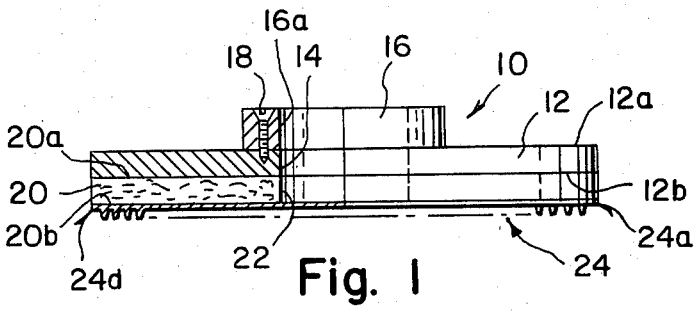
FIG. 1 is an elevational view, partially in section, showing the inventive drive pad assembly constructed according to the invention.
Figure 2:
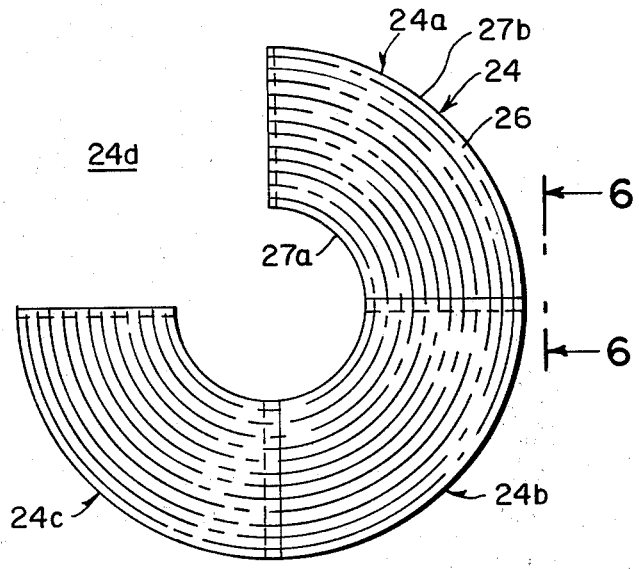
FIG. 2 is a bottom plan view diagrammatically showing the structure of FIG. 1, for purposes of clarity, a quadrant or sector of the grip plate or drive pad is removed to reveal the interfitting ledges of adjacent quadrants and peripheral rim segments.
Figure 6:
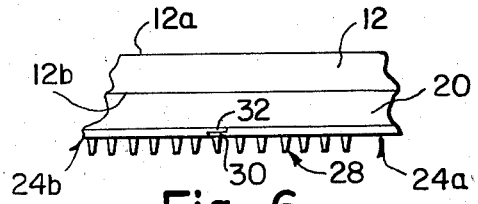
Figure 7:
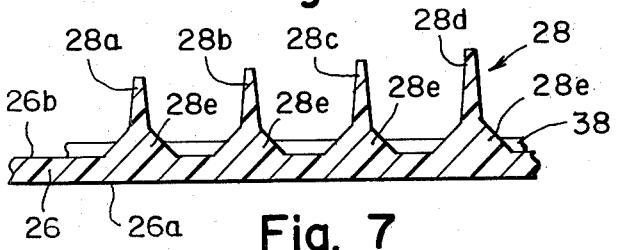
Figure 8:
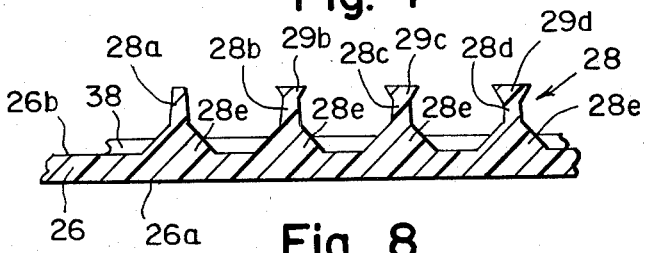
Figure 11:
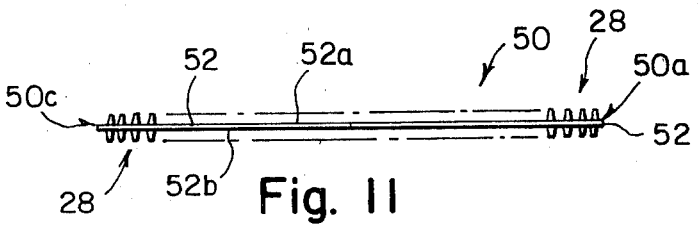
Figure 12:
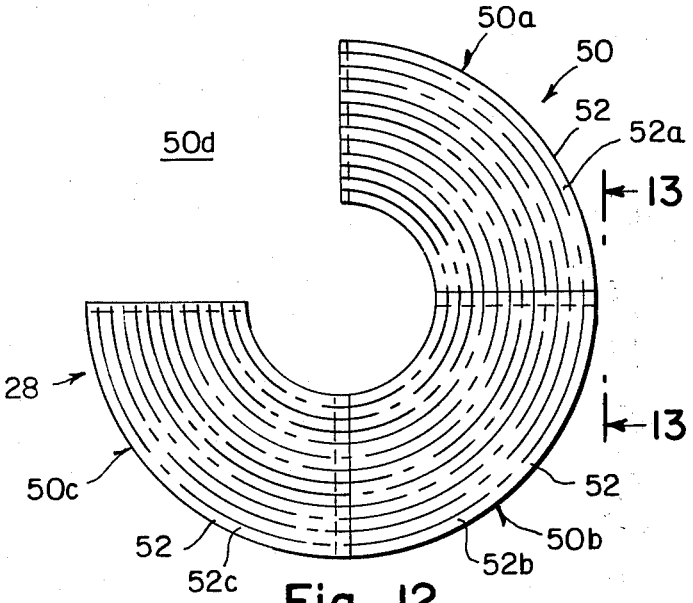
Figure 13:
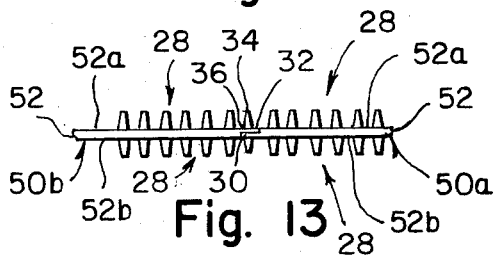
Figure 14:
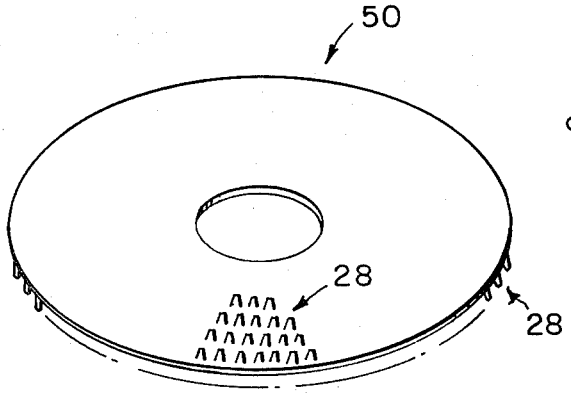
Figure 15:
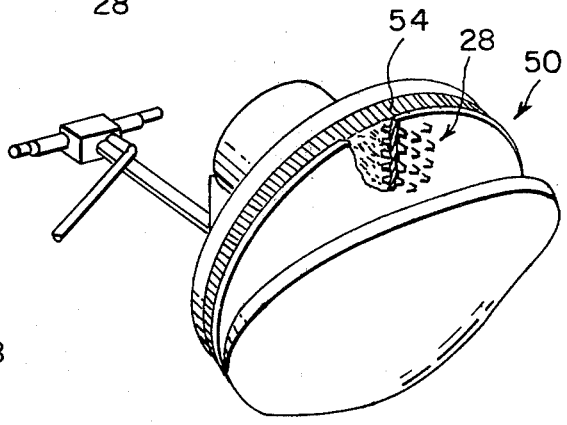

FIG. 3 is an enlarged plan view of the grip plate or drive pad of the present invention, for purposes of clarity a grip plate sector or quadrant is removed from the inventive pad assembly proper, and, as shown, the sector is comprised of an interfitting inner quadrant and an outer rim segment, the inner quadrants are shown joined by interfitting lateral ledges, and the outer rim segment is shown joined to the inner quadrant by means of a radially disposed annular skirt;

FIG. 4 is a view taken along the line 4—4 of FIG. 3 and looking in the direction of the arrows thus to reveal in detail the planar annular ribs that are formed on the outboard face of the inventive grip plate, and the interfitting pins and aperture structure formed on respective facing lateral ledges;

FIG. 5 is an enlarged fragmentary view taken on line 5—5 of FIG. 4 and looking in the direction of the arrows to reveal in detail the constant cross-section of the interlocking pins that extend from an interfitting lateral ledge;

FIG. 6 is a fragmentary elevational view taken along the line 6—6 of FIG. 2 and looking in the direction of the arrows to reveal how facing lateral ledges of adjacent inner sectors interlock along a common plane, and showing the linear pins projecting from the outboard surface of the grip plate or grip pad;

FIG. 7 is an enlarged fragmentary view, in section, taken along the line 7—7 of FIG. 3 and showing the varying lengths of respective ones of the linear pins before associated free ends thereof are upset;

FIG. 8 is an enlarged fragmentary view similar to FIG. 7 diagrammatically showing, in detail, representative ones of the linear pins after the same have been upset, the upsetting occurs to varying degrees, as shown;

FIG. 9 is a top perspective view of the inventive pad drive assembly showing the parts thereof as assembled;

FIG. 10 is a bottom perspective view of the inventive pad drive assembly showing how the tips of the linear pins are arranged to form a planar face adapted detachably to mesh with and engage the fibers of the selected maintenance pad;

FIG. 11 is an elevational view of another embodiment of the present invention showing a pad drive or grip plate with a plurality of linear pins disposed on both planar faces thereof whereby the pad can act as an interface between a conventional brush assembly and the selected maintenance pad;

FIG. 12 is a plan view of the drive pad or double sided grip plate of FIG. 11, for purposes of clarity a quadrant or sector comprising same is removed to show how the plate can be fabricated;

FIG. 13 is an enlarged elevational view taken along the line 13—13 of FIG. 12 and looking in the direction of the arrows to reveal how complementary lateral ledges mate along a common plane to form a singular structure, and reveal in detail the configuration of the linear pins;

FIG. 14 is a top perspective view of the structure of FIG. 11 showing the free ends of the linear pins on each side of the pad drive plate, these free ends present a planar face adapted to grip and interfit with the respective surface on which they engage; and FIG. 15 is a perspective view showing diagrammatically how the inventive double-sided grip plate of FIGS. 11 through 14 is used and applied to a conventional maintenance machine.

Referring to the drawings, FIGS. 1 through 10 show one embodiment of the inventive pad drive assembly. The pad drive assembly, indicated generally by reference numeral 10, comprises a substantially rigid annular planar back support 12 made from plywood or any such stock that exhibits dimensional stability under the expected loads. Circular support 12 is defined by two annular planar faces 12*a* and 12*b*, and a centrally disposed through-aperture 14 into which seats the drive shaft (not shown) of a maintenance machine that will be discussed later.

A rigid, circular riser block 16 concentrically is attached to planar face 12*a* of rigid back support 12 by means of a plurality of mechanical fasteners, as screws 18. Block 16 is formed with a central through-aperture 16*a* that aligns with and is sized complementary to the through-aperture 14 of support 12. The free or exposed end of riser block 16 fixedly receives a clutch plate (not shown) that is adapted to be locked detachably to the drive shaft of the maintenance machine, as is standard in this art. Aperture 16*a* of riser block 16 receives the drive shaft of the maintenance machine as the clutch plate is locked thereto for rotation therewith.

A planar annular impact, shock absorber cushion 20, defined by two substantially planar faces 20*a* and 20*b* and formed with a central through-aperture 22, is bonded to support 12 such that respective planar faces 12*b* and 20*a* are in back-to-back disposition, as shown. With this construction, through-aperture 22 of cushion 20 aligns concentrically or coaxially with apertures 16*a* and 14.

As the description proceeds, it will be clear that the shock absorbing cushion 20 forms the sole connection between the rigid back support 12 and the grip plate or drive face 24 to be described. Thus, the connecting shock absorber 20 is free of all other restraining means. As a consequence, it absorbs machine bounce forces before they are transmitted to the user, thus making it less tiring on the user. In addition, it absorbs starting and stopping rotary loads and shock forces which result in a longer lasting maintenance machine and maintenance pads.

The planar annular grip plate, indicated generally by reference numeral 24, is, preferably, comprises of a plurality of interfitting mating inner sectors, here shown as four inner annular quadrants 24*a*, 24*b*, 24*c*, and 24*d*, one of which, 24*a*, is shown in detail in FIGS. 3 and 4 for ease of description. The sectored or segmented structure 24 shown in FIGS. 3 and 4 and as will be mentioned later can be fabricated as a single monolithic integral whole instead of the interfitting mating sectors that are shown and described.

Each inner sector 24*a* of grip plate 24 is molded or cast as a duplicate of each other sector and is comprised of a substantially rigid circular planar base sector or segment 26 made of high impact polystyrene. Planar base sector 26 is defined by two substantially planar faces 26*a* and 26*b*. Planar base sector 26 is, in plan view, defined by an inboard, smaller annular radial edge 26*a*, and an outboard, larger annular radial edge 26*b*. Sector 26, and hence each quadrant 24*a*, 24*b*, 24*c*, and 24*d*, is delineated by two lateral edges 27*c* and 27*d* as shown and about which more is said below. One face, face 26*a*, thus forms a surface by which the same is bonded to face 20*b* of shock cushion 20.

A plurality of linear pins, indicated generally by reference numeral 28, are integrally cast or formed with base sector 26 and project substantially perpendicularly from one side thereof, side 26*b* as shown. More particularly, and now reference is made to FIG. 7, the individual pins, diagrammatically represented as pins 28*a*, 28*b*, 28*c* and 28*d*, are each formed with a pyramidal or conical base portion 28*e*, and are selectively arranged to be of varying lengths.

During formation of grip plate 24 or, more particularly, sector 24*a* thereof, and now reference is made to FIG. 8, the free ends of the pins are then upset. That is to say, their points or ends are deflected out of the normal line of the pin so as to cause the free end of a given pin to assume an enlargement. This enlargement functions as a gripping projection or hat 29*b*, 29*c*, and 29*d*, as shown. Each one of such enlargements operates to fit into the interstices of a selected pad and interlock with the fibers thereof thereby to provide a positive engagement or locking between pins 28 of grip plate 24 and the fibers of the selected maintenance pad. When comparing FIG. 7 with FIG. 8, it will be noticed that all pins above a given height that, in this case, are diagrammatically represented as pins 28*b*, 28*c* and 28*d*, have their respective free ends 29*b*, 29*c* and 29*d*, upset or enlarged in proportion to the amount of pin that extends above the given height. Put another way, since pin 28*d* has the greatest linear height, as seen in FIG. 7, it is given the largest upset end, as seen in FIG. 8. The other pins, diagrammatically represented as 28*b* and 28*c*, have their respective upset ends sized in proportion to their linear height, as shown.

Of course, it will be apparent that certain ones of the pins, typically those at the aforesaid given height or below it, will be left smooth or pointed allowing these last mentioned pins to more easily pierce or lance to engage those selected maintenance pads that have a high fiber density. Such dense pads would be difficult to penetrate with pins having upset ends owing to the compactness of fibers comprising these pads and the frontal area presented by a given upset end. Thus, those pins that are not upset will provide for a type of lancing means on the face of grip plate 24, or more particularly, sector 26, to penetrate into the fibers of the selected maintenance pad, and they act to supplement the fastening action of those upset ends that, initially, have difficulty penetrating deeply into the body or fibers of the selected pad.

Since drive face or grip plate 24 is comprised of mating annular sectors or quadrants 24*a*, 24*b*, 24*c*, and 24*d*, a planar lateral ledge or flat 30 is formed on one edge 27*c*, and a planar lateral ledge 32 is formed on edge 27*d*. Ledge 30 is integrally formed with and extends from surface 26*a* along edge 27*c* that defines an abrupt discontinuity of cross-section or step as it were, as shown. And, in somewhat corresponding manner, ledge 32 is integrally formed with and extends from surface 26*b* along edge 27*c* that delineates an abrupt discontinuity of cross-section or step as shown. Facing contiguous ledges 30 and 32 of adjacent sectors 24*a* and 24*b*, for example, are sized to interfit and overlie in a common plane in the manner described below.

Ledge 30 is integrally formed with a plurality of linear pins 34, of constant cross-section, that project upwardly from the ledge as shown. Ledge 32 is formed with a plurality of apertures 36 sized complementary to and thus adapted to receive associated ones of pins 34 of an adjacent facing ledge. This arrangement of complementary ledges and interfitting pins and apertures insures detailed alignment of mating sectors and structural load paths, while providing sufficient surface area to insure adequate bonded joint strength. Thus, when adjacent inner sectors or quadrants 24*a* and 24*b*, for example, that comprise grip plate or pad drive 24 are placed contiguous to one another, pins 34 of ledge 30 are designed to fit into and mate with corresponding aperture 36 of ledge 32. Hence, when the lateral ledges overlie, they mate along a common plane and their overall thickness more or less equals the thickness of base sector 26 that comprises the given quadrants.

When adjacent, facing lateral ledges 30 and 32 are placed upon each other, the ledges can be bonded or otherwise adhesively secured with the given ones of pins 34 that are upstanding from ledge 30 received in associated apertures 36 on an overlying ledge 30. When pins 34 are upset, they will act to prevent the separation of mating ledges 30 and 32. However, the upsetting of pins 34 at the overlying ledges is not necessarily relied upon to prevent the separation of mating ledges, given the fact that adjacent inner sectors or quadrants 24*a*, 24*b*, 24*c*, and 24*d*, as the case may be, are secured together at their overlying ledges by adhesives, heat bonding, sonic welding and the like.

Grip plate 24 when formed in the nature of quadrants 24*a* each comprised of base members 26, will, preferably, be formed integrally with a plurality of arcuate rib segments 38 disposed on face 26*b* of base sector 26. Rib segments 38 extend minutely upwardly from surface 26*b* and they are arrayed in a more or less spaced, concentric, upstanding, ring-like pattern on face 26*b* and thus are disposed in the concentrically defined spaced between circularly arrayed rows of pins 28.

In addition to adding stiffness or dimensional stability overall, the ribs function as bottoming pads or spacers on the respective sectors on which they are formed to support the selected maintenance pad, when the maintenance pad is impressed upon pins 28, a minimum distance from surface 26*b*. Stated differently, ribs 38 act as "stops" and allow the use of selected maintenance pads of a variety of thicknesses. The ribs will insure that the working face of the selected pad will be maintained above the free ends of pins 28 thus insuring complete safety to both the floor and the pins themselves.

The inboard planar face, face 26*a*, of a given base sector 26 is then bonded to the outboard face, face 20*b* of shock cushion 20 with adjacent ledges 30 and 32 interfitting along a common plane, as described above. When inner sectors 24*a*, 24*b*, 24*c* and 24*d* are assembled on cushion 20, this results in the structure seen clearly in FIGS. 1, 7 and 8 and it presents the circularly arrayed face of pins 28 extending outboard therefrom, as shown.

Generally, the diameter presented by the interfitting array of inner sectors comprising drive face or grip plate 24 will vary from 11 to 20 inches. However, the design flexibility afforded by the instant invention allows the joining of additional and outer peripheral rim segments of larger radial dimensions so as to increase the diameter of the circular face presented by grip plate 24.

To increase the diameter of face 24, an outer annular peripheral rim segment 40 can be added to the planar circumferential rim region of each inner segment 24*a*, 24*b*, 24*c* and 24*d*. Planar peripheral rim segment 40 is, essentially, similar to segments 24*a*, 24*b*, 24*c*, and 24*d*. Thus, planar rim segment 40 has two planar faces 40*a* and 40*b*. Outer planar rim segment 40 is defined by an inboard smaller annular edge 41*a* that is complementary to larger annular edge 27*b* of segment 26, and an outboard annular edge 41*b* that defines the outboard peripheral arcuate rim of segment 40. It will be noticed that when looking at FIG. 3, the lateral edges of each outer rim segment 40 are formed with planar lateral ledges 30 and 32 as described above with reference to inner sectors 24*a* through 24*d*.

Face 40*a* of rim segment 40 is formed with a plurality of upstanding linear pins 28 similar to the array of linear pins 28 discussed with reference to the earlier mentioned sectors and which are shown in detail in FIGS. 7 and 8. A plurality of arcuate rib segments 38 are, in a manner similar to those rib segments 38 discussed earlier, formed on surface 40*a*, and they extend minutely upwardly therefrom and are integral therewith. Ribs 38 on outer peripheral rim segment 40 are disposed in concentric annular array in the circularly defined spaces between the circularly arrayed pins.

An arcuate, radially oriented planar ledge or skirt 42 formed as an extension of face 40*a* extends radially inwardly from the inboard arcuate rim of planar rim segment 40. Planar ledge or skirt 42 extends in cantilever disposition from the inboard arcuate rim of annular segment 40 and is defined by an inboard planar face 42*a* that is essentially co-planar with face 40*a*. A plurality of spaced apertures 44 are arrayed in arcuate disposition on radially oriented skirt 42 and are disposed transversely therethrough.

A plurality of tapered linear pins 46, of constant cross section, extend upwardly from face 26*a* and are arrayed in arcuate disposition adjacent to or along the larger radial arc of each inner sector 24*a*, 24*b*, 24*c* and 24*d* near the planar radial periphery thereof. As seen in FIG. 3, pins 46 are arranged on a given face 26*a* of each inner sector in a manner so as to be complementary positioned with respect to apertures 44 whereby a given pin 46 upstanding from planar face 26*a* is received in a corresponding one of apertures 44 on radial skirt 42 as the radial skirt is placed over or overlies the outboard peripheral arcuate rim region of each inner base sector 26.

As pins 46 are received in associated apertures 44, face 42*a* of skirt 42 drops into facing contact with outboard face 26*a* of an inner base sector 26 that comprises a respective sector or quadrant 24*a*, 24*b*, 24*c* and 24*d*. The aforementioned planar faces can be bonded one to the other by adhesives, heat bonding, electric welding and the like, in addition to the locking action afforded by upsetting the free ends of pins 44. Either prior to or after outer annular rim segment 40 is joined to inner base sector 26 comprising each inner sector, as noted above, face 40*b* is secured to face 20*b* of shock cushion 20.

Use and operation of the embodiment of FIGS. 1 through 10 is straightforward. Assembly 10 is detachably locked to the drive shaft of the maintenance machine in a conventional manner by means of a clutch plate (not shown). The selected maintenance pad is then manually pressed onto the free ends of linear pin structure 28 in such manner as to be substantially concentric with the circular periphery presented by face 28. Of course, it will be readily apparent that owing to the smooth, more or less pointed configuration presented by pins 28*a*, these pins pierce and lance the fibers of the selected pad, initiallly grabbing the same. The selected pad is then placed face down on the floor and the machine started.

As face 28 comprised of the array of substantially rigid linear pins drives the selected maintenance pad, the pins comprising the last mentioned face are driven firmly into the fabric of the selected pads gripping and holding the same. More particularly, during operation of the inventive structure and under the constant aggravation and stressing of the fibers comprising the selected maintenance pad, the upset ends of the array of pins 28 find their way into the interstices of the fibers comprising the selected pad and become firmly imbedded therein locking the selected maintenance pad on the pins.

The conical or pyramidal base region 28*e* of each pin provides for relatively stiff lateral support of each pin during the constantly accelerated movement thereof. Ribs 38 act to keep the selected pad from bottoming on faces 26*b* and 40*a* and thus for certain thicknesses of pad, maintain the exposed face of the pad a minimum height above the exposed ends or tips of pins 28.

During start-up and while in operation, shock cushion 20 acts to absorb certain loads and thus dampen their impact before being transmitted to the motor and operator. When it is desired to change the selected pad, the same is merely pulled from or unpeeled off of the array of linear pins.

In the discussion of the inventive structure outlined above, pad drive assembly 10 included shock cushion 20. It is to be understood that the present invention is not to be limited to the imposition of a shock cushion between the inboard planar face of grip plate 24 and rigid base member 12. In certain applications, and particularly when cost is a factor, cushion 20 can be deleted and the inboard planar face of grip plate 24 or, more particularly, face 26*a* of inner base sector 26 or, face 40*b* of outer annular rim segment 40, or both, can be bonded to planar face 12*b* of rigid base support 12.

Turning now to FIGS. 11 through 15, there is shown another embodiment of the present invention. In the embodiment of FIGS. 11 to 15, the pad drive of the present invention is indicated generally by reference numeral 50. Pad drive 50 is, in many respects, a double sided version of the grip plate 24 discussed above. As such, pad drive 50 may comprise a high impact polystyrene planar annular base disc that can be formed as a one piece monolithic structure or in a plurality of mating sectors or quadrants 50*a*, 50*b*, 50*c* and 50*d*, as shown.

Each quadrant is, more or less, a double sided version of quadrants 24*a* through 24*d* which were discussed above, and so each quadrant or sector is comprised of a substantially rigid planar base sector 52 that may be made of plastic. Each plastic sector 52 comprising each quadrant 50*a*, 50*b*, 50*c* and 50*d* has two substantially planar faces 52*a* and 52*b*. A plurality of upstanding linear pins 28, in all respects similar to linear pins 28 discussed with reference to FIGS. 1 through 10, are arrayed and project from each side 52*a* and 52*b* as shown. Thus, the pins that project from sides or faces 52*a* and 52*b* have their free ends upset as diagrammatically shown in FIGS. 7 and 8.

Quadrants 50*a* through 50*d*, each being designed to interfit along lateral mating edges, are each formed with complementary sized planar lateral ledges 30 and 32 that are in all respects similar to lateral ledges 30 and 32 discussed with reference to FIGS. 1 through 10. Ledges 30 and 32 of sectors 50*a*, 50*b*, 50*c*, and 50*d* are sized to interfit and lock together, and so ledge 30 is formed with a plurality of linear pins 34 of constant cross section, as noted above. And, ledge 32 is formed with a plurality of apertures 36 sized complementary to and adapted to receive associated ones of pins 34 of an adjacent and facing ledge. Thus, adjacent ones of sectors 50*a*, 50*b*, 50*c* and 50*d* can be locked together in detailed alignment while the interfitting nature of respective lateral ledges insures structural load paths between sectors and yields adequate surface area for good bonded joint strength.

Use and operation of the double sided pad 50 is as follows. The pad is brought up to a conventional bristled drive brush 54 and pressed thereagainst causing linear pins 28 projecting from one face of interface pad 50 to mesh with and detachably grab these bristles. This disposes the other planar face of interface pad 50 and linear pins 28 projecting therefrom outboard from brush head 54 and substantially concentric therewith. The selected maintenance pad is then pressed onto the exposed pins 28 extending from the last mentioned face, and by the action described with reference to FIGS. 1 through 10, becomes detachably locked onto linear pins 28.

Linear pins 28 in all of the foregoing embodiments are shown and described as projecting essentially perpendicularly off of the face from which it is cast or formed. However, the invention is not to be so limited because all or selected ones of pins 28 can be angled or canted with respect to the vertical, and may be tilted to or from the central longitudinal axis of the circular face.

The height of pins can vary, and in practice they vary from 0.060 inch to 1.50 inch. The preferred range is 0.375 inch to 0.750 inch, and the preferred height is 0.500 inch. Longer pins tend to bend too much in response to the forces they experience on the machine and thus require a thicker pin to maintain dimensional stability under load. Generally, the shank of pin 28, seen diagrammatically as 29 in FIG. 7, except those used in the mating ledges, will have (before upsetting) a taper from the free end to the base of approximately 1.5° to 15° to the vertical, with the preferred range between 3° to 8° to the vertical.

Of course, while the structure comprising the embodiments shown in FIGS. 1 through 15 has been shown as comprised of four sectors, two, three, five or more mating sectors can be used. Indeed, where tooling costs are not an important factor, planar drive structure 24 and interface pad 50 can be case as a single, monolithic annular whole.

While only a few embodiments of the present invention have been shown and described, it is understood that many changes and modifications can be made hereto without departing from the spirit and scope hereof.

What is claimed is:

1. A pad drive assembly for detachably gripping a selected maintenance pad to be rotatably driven by a floor maintenance machine comprising a rigid, substantially circular back support defined by two faces, one of which is substantially planar and a substantially rigid pad drive of substantially planar configuration comprised of a plurality of mating sectors and defined by two substantially planar faces, one of the last mentioned planar faces being attached to said one face of said back support for rotation therewith, the other planar face of said pad drive being formed with a plurality of upstanding, substantially rigid pins that extend therefrom and that are adapted detachably to grip a selected maintenance pad and rotatably drive the same.

2. The pad drive assembly of claim 1, said pins being rigidified at thickened bases, and selected ones of said plurality of linear pins having their respective free ends upset thereby defining an engaging enlargement thereat.

3. The pad drive assembly of claim 1, each of said mating sectors being formed with planar ledge means that extend from peripheral edge regions thereof and with which contiguous sectors are joined.

4. The pad drive assembly of claim 1, each of said sectors being defined by two lateral edges, each of said lateral edges including a planar ledge extending therefrom so as to be substantially coplanar therewith, the two planar ledges of contiguous sectors each adapted to interfit along a common plane and thereby lock the same together.

5. The pad drive assembly of claim 4, one of the two interfitting planar ledges of contiguous sectors being defined by a plurality of spaced apertures, the other one of the interfitting planar ledges being formed with a plurality of upstanding linear pins of substantially constant cross section, given ones of the last mentioned pins being in registration with associated ones of said apertures whereby when the planar ledges interfit, individual ones of said last mentioned pins are received in associated ones of said apertures locking the ledges together.

6. The pad drive assembly of claim 1, said other planar face of said pad drive being formed with a plurality of rib segments that upstand therefrom thereby to maintain the selected maintenance pad a given distance from the last mentioned face.

7. A pad drive assembly that detachably connects a selected maintenance pad to and for rotation by floor maintenance machines comprising a rigid rotatable substantially circular back support defined by two substantially planar faces, a shock absorber cushion defined by two substantially planar faces one of which is attached to one of the faces of said back support so as to be rotatable therewith, a substantially rigid grip plate of essentially planar configuration comprised of a plurality of mating sectors and defined by two substantially planar faces, one of the faces of said grip plate being attached to the other face of said shock absorber cushion for rotation therewith, the other face of said grip plate being formed with a plurality of upstanding substantially rigid pins that extend therefrom and that are adapted detachably to engage with and grip a selected maintenance pad and rotatably drive the same by way of the floor maintenance machine.

8. The pad drive assembly of claim 7, selected ones of the free ends of said linear pins being upset so as to form an enlargement thereat so as to detachably interlock with defining walls of the selected maintenance pads.

9. The pad drive assembly of claim 8, said linear pins having a base region from which they upstand from said other face of said grip plate and being of conical configuration thus to give added support to the pins progressively along their lengths.

10. The pad drive assembly of claim 7, each of said sectors being defined by two lateral edges, each lateral edge including a planar ledge means at which contiguous sectors are joined together to form a substantially circular grip plate.

11. The pad drive assembly of claim 10, said planar ledge means each including an interfitting seat, said seats of contiguous facing sectors being of complementary configuration and adapted to interfit substantially along a common plane along which said sectors are joined together.

12. A pad drive interface for use with rotating floor maintenance machines that employ a brush-like drive face, said drive pad interface comprising a substantially rigid grip plate, said grip plate being defined by two substantially planar faces, each of said faces being formed integrally with a plurality of upstanding, substantially rigid linear pins that extend therefrom and are arrayed in substantial back-to-back disposition whereby when the substantially linear pins on one face of said grip plate are pressed onto the brush-like drive face, the last mentioned pins detachably grip the brush-like drive face for rotation therewith while the linear pins on the other face of said grip plate are adapted detachably to grip a selected maintenance pad and rotatably drive the same with the rotating floor maintenance machine, said grip plate being circular and formed of a plurality of mating sectors, each of said sectors being defined by two lateral edges, each of said lateral edges being formed with planar ledge means and at which contiguous facing sectors are joined together to form said circular grip plate.

13. The pad drive interface of claim 12, selected ones of said pins on each face of said grip plate having their free ends upset thereby to form an engaging enlargement thereat.

14. The pad drive interface of claim 13, selected ones of said pins on each face of said grip plate being at an angle with respect to a line drawn perpendicular to the plane of a respective one of said faces of said grip plate.

15. For use on a pad drive assembly that detachably connects a selected maintenance pad with a rotatable floor maintenance machine and wherein the drive assembly has a rigid back support, grip plate means of generally planar construction comprised of a plurality of mating sectors and being defined by two substantially planar faces, one of said faces adapted to be coupled to and driven by the back support, the other of said planar faces being formed with a plurality of upstanding, substantially rigid linear pins that extend therefrom with selected ones of said linear pins having their free ends upset thereby to form an engaging enlargement thereat whereby when a selected maintenance pad is pressed thereon, the upset ends firmly grab the fibers of the maintenance pad detachably locking same thereto.

16. The pad drive assembly of claim 15, said mating sectors being comprised of a plurality of discrete, interfitting inner and outer sectors, each of said inner sectors being defined by a smaller inboard annular radial edge and a larger outboard annular radial edge.

17. The pad drive assembly of claim 16, each of said interfitting inner sectors being defined by two lateral edges, each lateral edge including a laterally disposed flat extending therefrom and with which contiguous inner sectors are joined.

18. The pad drive assembly of claim 17, the laterally disposed flats of contiguous inner sectors being of complementary configuration and adapted to interfit and mate along a common plane.

19. The pad drive assembly of claim 18, said outer sectors being of generally planar construction having two substantially planar faces, each said outer sector being defined by an inboard smaller arcuate annular edge sized complementary to said outboard annular radial edge of a given one of said inner sectors, and an outboard larger arcuate annular edge defining the circumferential periphery of each of said outer sectors, each of said outer sectors including an arcuate radially oriented planar skirt extending from said inboard arcuate annular edge thereof and adapted to overlie and mate with the other annular peripheral region of a given one of said inner sectors.

20. The pad drive assembly of claim 19, each of said outer sectors being defined by two lateral edges, each lateral edge being formed with a lateral disposed skirt extending therefrom so as to be substantially coplanar therewith, the lateral skirts of facing contiguous outer sectors adapted to interfit and mate along a common plane and thereby lock the same together.

21. The pad drive assembly of claim 15, cushioning means between and coupling said grip plate with said rigid back support in spaced relation free of other restraining means therebetween to absorb rotary shock forces therebetween.

* * * * *